US006202270B1

(12) United States Patent
Bowman et al.

(10) Patent No.: US 6,202,270 B1
(45) Date of Patent: Mar. 20, 2001

(54) CREMATION CONTAINER FOLDABLE INTO COMPACT CONFIGURATION FOR SHIPPING

(75) Inventors: Pat Bowman, Holton; Tom Heil, Batesville; Rodger Jones, Indianapolis; James Maple, Batesville; Daniel J. Parker, Connersville; Ed Scheele, Batesville, all of IN (US); Samacha Somtrakool, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/312,301

(22) Filed: May 14, 1999

Related U.S. Application Data

(60) Provisional application No. 60/125,273, filed on Mar. 19, 1999.

(51) Int. Cl.[7] ..... A61G 17/00

(52) U.S. Cl. ..... 27/4; 27/1

(58) Field of Search ..... 27/1, 2, 4, 14, 27/19, 35, 16, 17, DIG. 1; 220/4.28, 6

(56) References Cited

U.S. PATENT DOCUMENTS

| | | | | |
|---|---|---|---|---|
| 1,003,107 | * | 9/1911 | Heyman . | |
| 2,221,504 | * | 11/1940 | Beasley et al. . | |
| 2,914,210 | * | 11/1959 | Paston . | |
| 4,135,279 | * | 1/1979 | Covington | 27/4 |
| 4,151,630 | | 5/1979 | Havey . | |
| 4,517,713 | | 5/1985 | Swallert . | |
| 5,307,545 | * | 5/1994 | Stoltz | 27/4 |
| 5,586,679 | * | 12/1996 | Thomas | 27/4 |
| 5,622,276 | * | 4/1997 | Simmons . | |
| 5,661,879 | * | 9/1997 | Kelly | 27/4 X |
| 5,709,016 | | 1/1998 | Gulick et al. . | |
| 5,960,978 | * | 10/1999 | Jenkins | 27/14 X |
| 5,964,014 | * | 10/1999 | Wang et al. | 27/2 |

FOREIGN PATENT DOCUMENTS

| | | |
|---|---|---|
| 233946 | 5/1925 | (GB) . |
| 517616 | 2/1940 | (GB) . |
| 1057318 | 2/1967 | (GB) . |

* cited by examiner

*Primary Examiner*—Terry Lee Melius
*Assistant Examiner*—William L. Miller
(74) *Attorney, Agent, or Firm*—Wood, Herron & Evans, L.L.P.

(57) ABSTRACT

A cremation container is foldable into a compact configuration for shipping purposes and is unfolded and erected at its destination. The cremation container comprises a bottom, a pair of side walls pivotally connected to the bottom, a pair of end walls pivotally connected to the bottom, and a cover removably positionable atop the pair of side walls and the pair of end walls. One pair of the pair of side walls and pair of end walls is foldable onto the bottom, and the other pair of the pair of side walls and pair of end walls is foldable onto the one pair of the pair of side walls and the pair of end walls, to thereby compactly configure the container for shipping. Preferably, the pair of side walls are foldable onto the bottom and the pair of end walls are foldable onto the pair of side walls. The lid comprises a pair of equal length lids positionable on the pair of side walls when the pair of side walls are folded onto the bottom and positionable between free edges of the pair of end walls when the pair of end walls are folded onto the pair of side walls.

29 Claims, 6 Drawing Sheets

CREMATION CONTAINER FOLDABLE INTO COMPACT CONFIGURATION FOR SHIPPING

RELATED APPLICATIONS

This application is a continuation-in-part application of pending U.S. provisional application Serial No. 60/125,273 filed Mar. 19, 1999, which is hereby incorporated by reference herein.

FIELD OF THE INVENTION

This invention relates generally to caskets, and more particularly to that type of casket known as a cremation container.

BACKGROUND OF THE INVENTION

Caskets have traditionally been employed for burial of the dead, both for in-ground burial and above-ground interment. Caskets are normally fabricated from fine furniture-grade wood or from highly polished/finished sheet metal for aesthetic reasons. So-called cremation containers, on the other hand, may be fabricated of cardboard, hardboard or plywood, and as such are usually much less ornate than wood or metal caskets and therefore much less expensive, and have been employed as containers for the dead for which the family has chosen cremation as the means for ultimate disposition of the body. Both caskets and cremation containers traditionally include a lower shell or body portion and an upper cap or lid portion closeable on the lower portion. Due to their size and shape neither caskets nor cremation containers are cost-effectively shipped.

Efforts at increasing the cost-effectiveness of shipping caskets and cremation containers have been directed toward the design and development of so-called "knock-down" or "ready-to-assemble" caskets, that is to say, caskets which are shipped in a non-erected, compact package which are then erected at the shipping destination. A major goal of designers of such knock-down caskets has been to produce designs which are relatively quickly and simply erected with few or no tools being required. Success in this area has been more readily achieved in the case of cremation containers rather than in caskets, as cremation containers are by their very nature much less expensive than caskets and as such the fabrication techniques employed in knock-down designs detract from their appearance to a much lesser degree than do they from caskets.

One example of a knock-down casket is disclosed in the assignee's U.S. Pat. No. 5,709,016, hereby incorporated by reference herein as if fully set forth in its entirety. It is desirable to improve upon the design of the casket in the assignee's '016 patent, as particularly relates to cremation containers.

SUMMARY OF THE INVENTION

In accordance with the principles of the present invention, a cremation container is provided which is foldable into a compact configuration for shipping purposes which is then unfolded and erected at its destination. The cremation container comprises a bottom, a pair of side walls pivotally connected to the bottom, a pair of end walls pivotally connected to the bottom, and a cover removably positionable atop the pair of side walls and the pair of end walls. One pair of the pair of side walls and pair of end walls is foldable onto the bottom, and the other pair of the pair of side walls and pair of end walls is foldable onto the one pair of the pair of side walls and the pair of end walls, to thereby compactly configure the container for shipping.

In a preferred embodiment of the present invention, the pair of side walls are foldable onto the bottom and the pair of end walls are foldable onto the pair of side walls. The lid comprises a pair of equal length lids positionable on the pair of side walls when the pair of side walls are folded onto the bottom and positionable between free edges of the pair of end walls when the pair of end walls are folded onto the pair of side walls.

The bottom comprises a rectangular frame and a panel secured to the frame. The frame is fabricated of cotton wood and the panel is fabricated of oriented strand board. The oriented strand board panel is secured to the rectangular cotton wood frame with wood glue. The rectangular frame comprises a pair of side frame members and a pair of end frame members, and each of the pair of end frame members includes a cut-out therein extending upwardly from a lower edge thereof which serves as a hand hold.

Each of the pair of end walls comprises a panel, a pair of lateral edge frame members one of which is secured to each lateral edge of the panel and a top edge frame member secured to a top edge of the panel. The frame members are fabricated of cotton wood and the panel is fabricated of luan plywood. The luan plywood panel is secured to the cotton wood frame members with wood glue.

Each of the pair of side wall comprises a panel and a top edge frame member secured to a top edge of the panel. The frame member is fabricated of cotton wood and the panel is fabricated of luan plywood. The luan plywood panel is secured to the cotton wood frame member with wood glue. Each end edge of each side wall panel abuts an inwardly facing surface of a respective end wall lateral edge frame member when assembled. A fastener fastens each end edge of the side wall panel to the respective end wall lateral edge member. The fastener is a plastic Christmas tree fastener, the end edge of the side wall panel including a through hole therethrough and the respective end wall lateral edge frame member including a blind hole therein, the Christmas tree fastener passing through the through hole and residing in the blind hole to thereby retain the end edge of the side wall panel against the inwardly facing surface of the respective end wall lateral edge member.

Each of the pair of side walls are pivotally connected to the bottom with a cardboard living hinge. Alternatively, each of the pair of side walls are pivotally connected to the bottom with metal hinges. The pair of end walls are pivotally connected to the bottom with metal hinges.

The lid comprises a rectangular frame and a panel secured to the frame. The frame is fabricated of cotton wood and the panel is fabricated of luan plywood. The luan plywood panel is secured to the rectangular cotton wood frame with wood glue. The lid preferably is a pair of equal length lids each of which comprises the above-described rectangular frame and panel secured thereto. The pair of lids are fastened to the top edges of the pairs of side walls and end walls with dowel pins.

In an alternative embodiment of the cremation container of the present invention, a locking lever is pivotally attached to either one of the side wall or the end wall of adjacent side and end walls and is cooperable with the other adjacent side or end wall to prevent the one wall from collapsing. Preferably, the locking levers are pivotally attached near an end edge of each side wall. There is a notch in a lateral edge of an adjacent end wall. The locking lever is pivotable into engagement with the notch to prevent the side wall from collapsing. The cover may include a plurality of pairs of cleats secured thereto, i.e. to the under side thereof. The upper edges of the side and end walls fit between respective cleats of the pairs of cleats to secure the cover onto the side and end walls. The alternative embodiment cremation container further includes a polyethylene bag for placement into the container to collect fluids.

These and other advantages of the present invention will become more readily apparent during the following detailed description taken in conjunction with the drawings herein, in which:

DETAILED DESCRIPTION OF THE INVENTION

Figure 1:
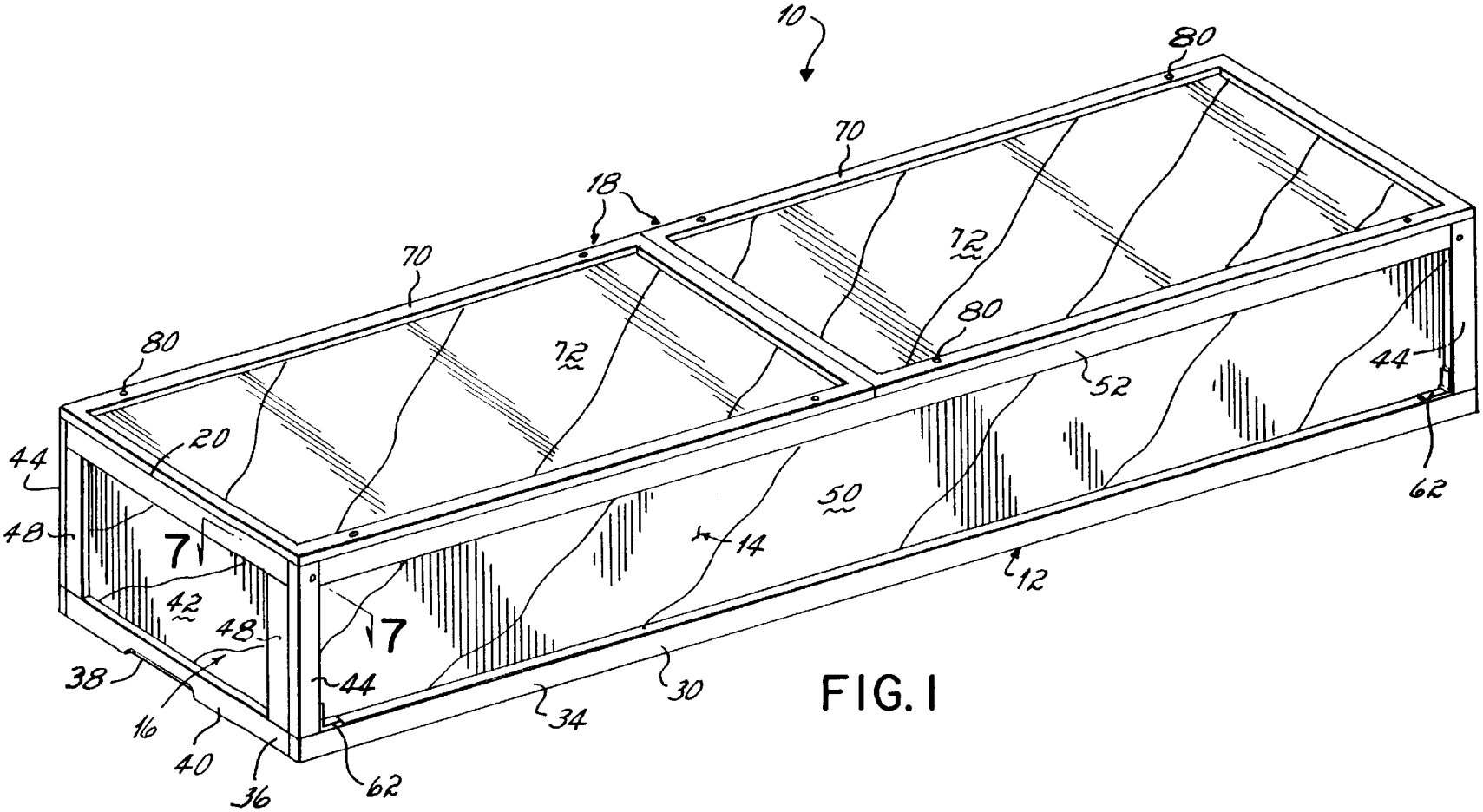
FIG. 1 is a perspective view of the erected cremation container of the present invention.

Referring first to FIG. 1, there is illustrated a cremation container 10 according to the principles of the present invention. The cremation container 10 is foldable into a compact configuration for shipping, and is erected at its destination. The container 10 includes a bottom 12, a pair of side walls 14, 14 pivotally connected to the bottom 12, a pair of end walls 16, 16 pivotally connected to the bottom 12, and a pair of equal length covers 18, 18 positionable atop the pair of side walls 14, 14, and the pair of end walls 16, 16. One pair of the pair of side walls 14, 14 and the pair of end walls 16, 16 is foldable onto the bottom 12, and the other pair of the pair of side walls 14, 14 and the pair of end walls 16, 16 is being foldable onto the one pair of the pair of side walls 14, 14 and the pair of end walls 16, 16, to thereby compactly configure the container for shipping.

Figure 2:
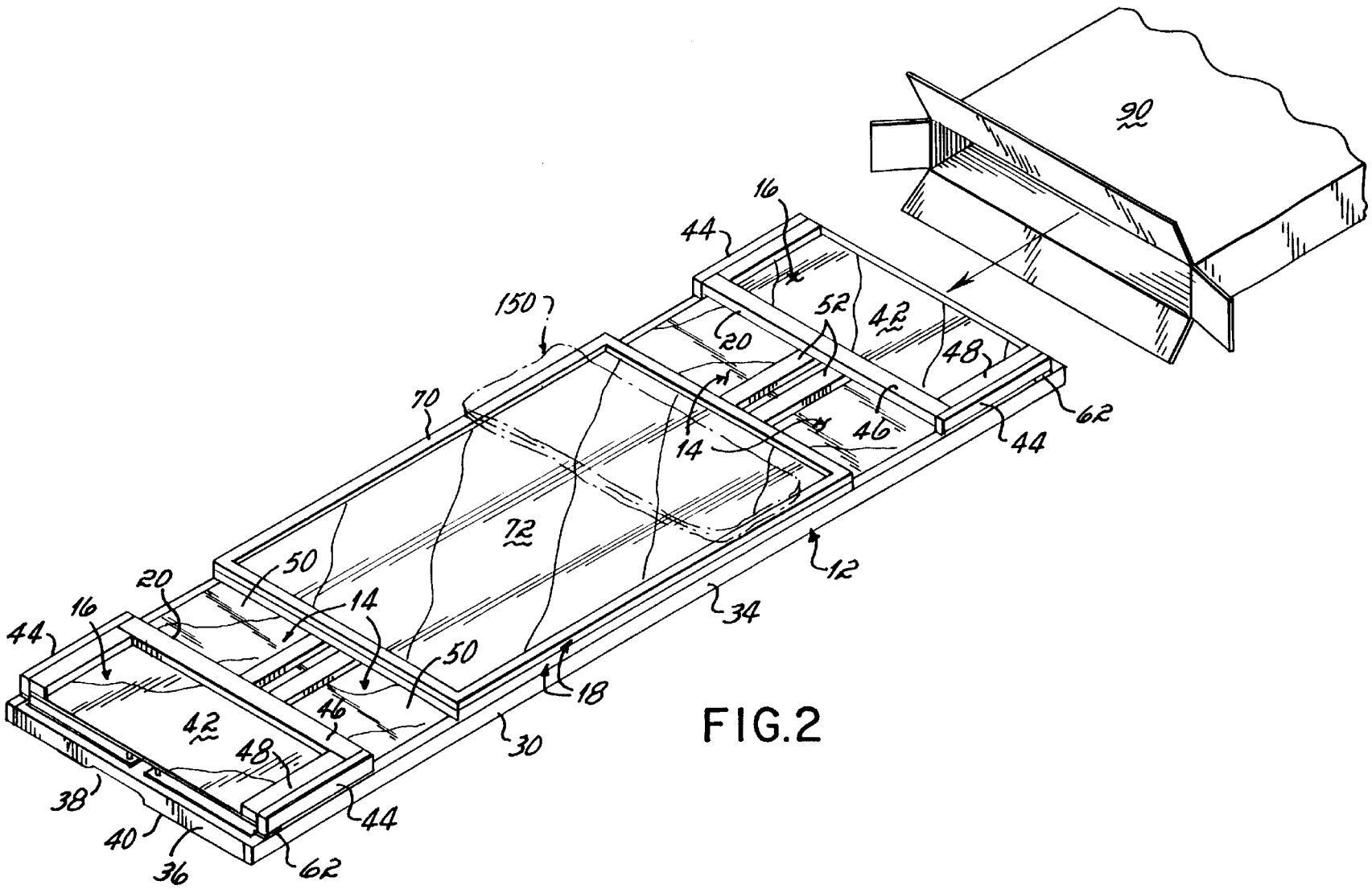
FIG. 2 is a perspective view of the cremation container of FIG. 1 folded into its shipping configuration and illustrated being removed from its shipping container.
Figure 3:
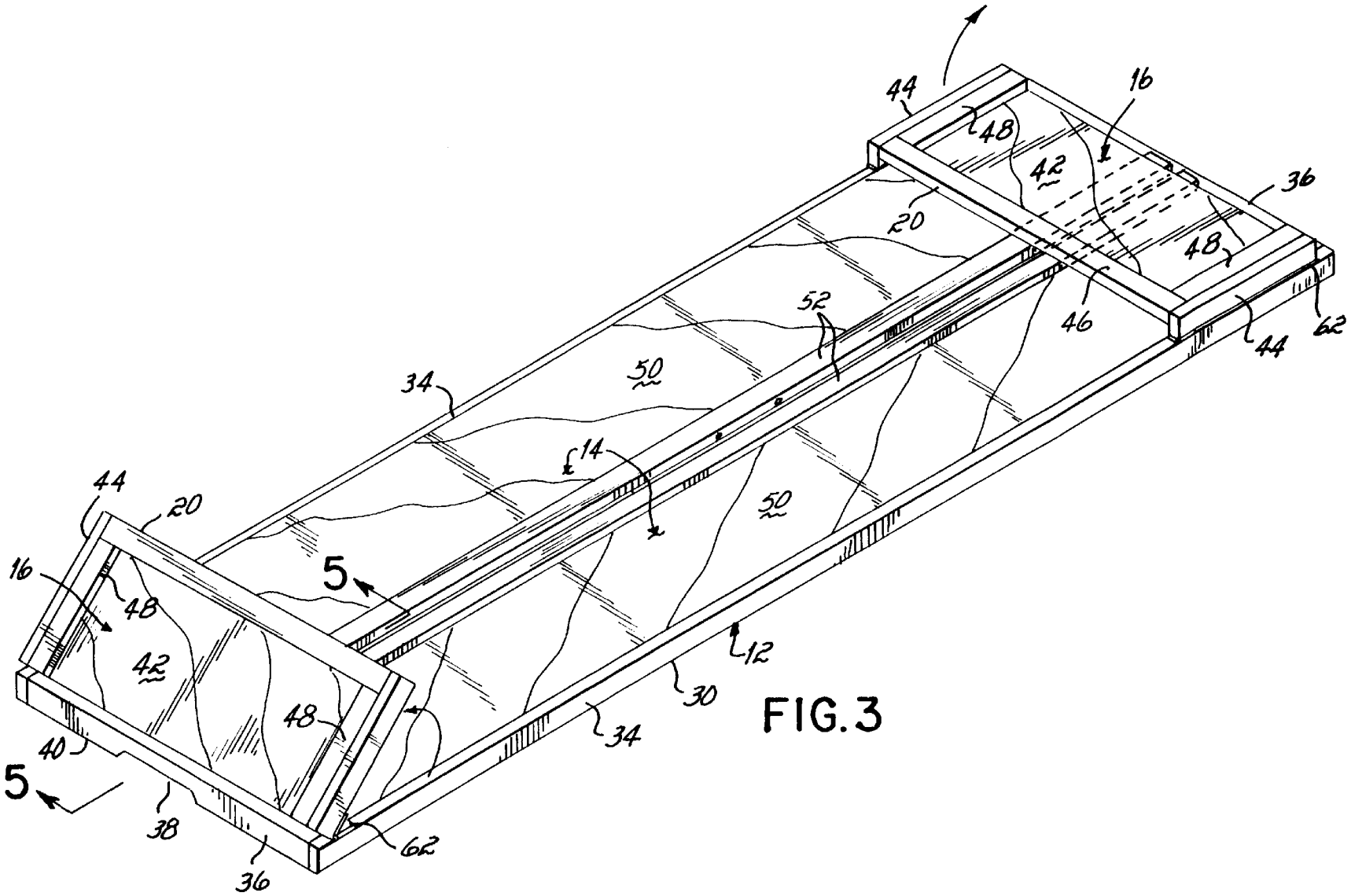
FIG. 3 is a perspective view of the cremation container of FIG. 2 illustrating the step of unfolding the pair of end walls.
Figure 4:
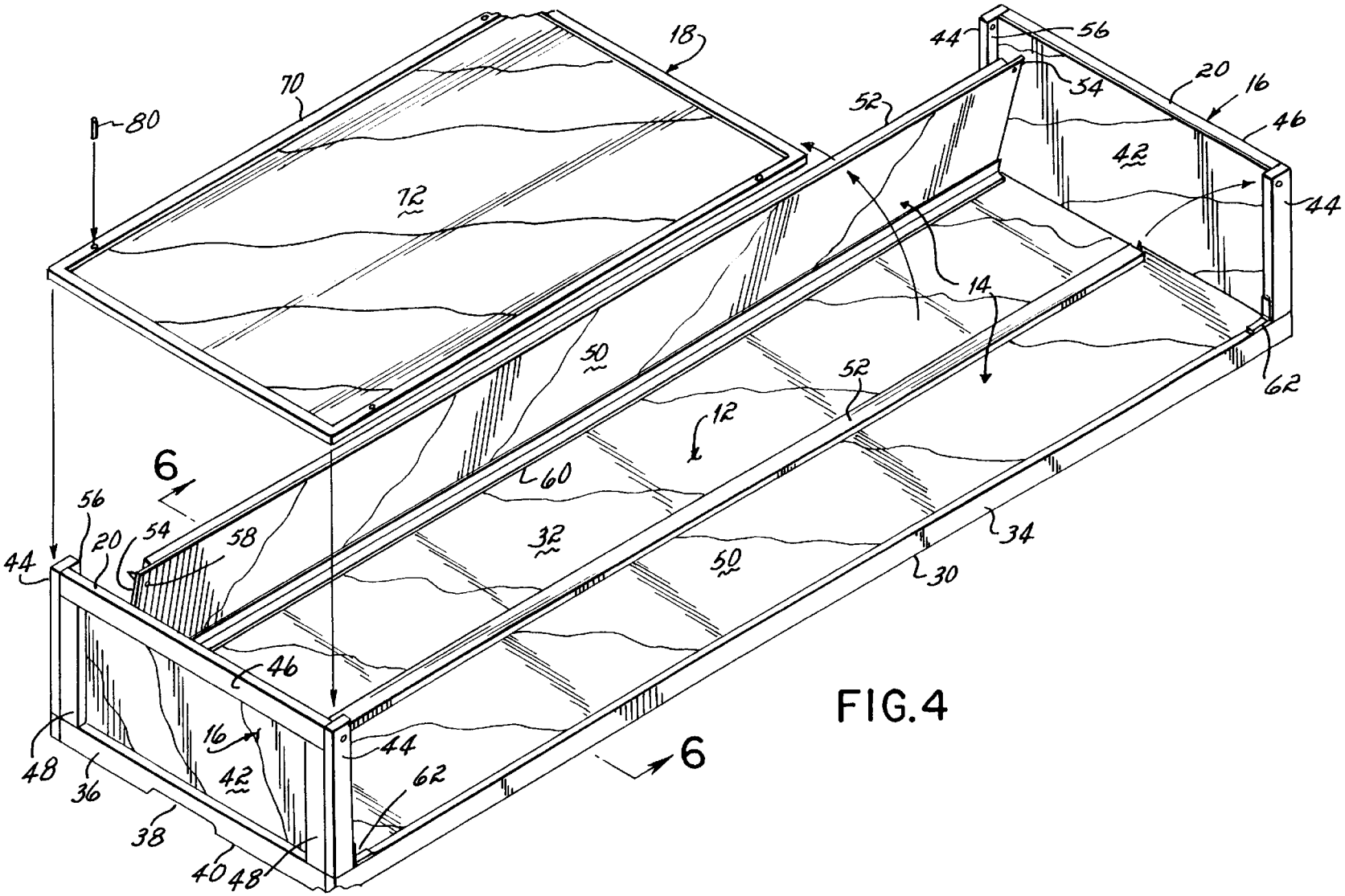
FIG. 4 is a perspective view of the cremation container of FIG. 3 with end walls unfolded and illustrating the step of unfolding the pair of side walls and installing the lids.
Figure 5:
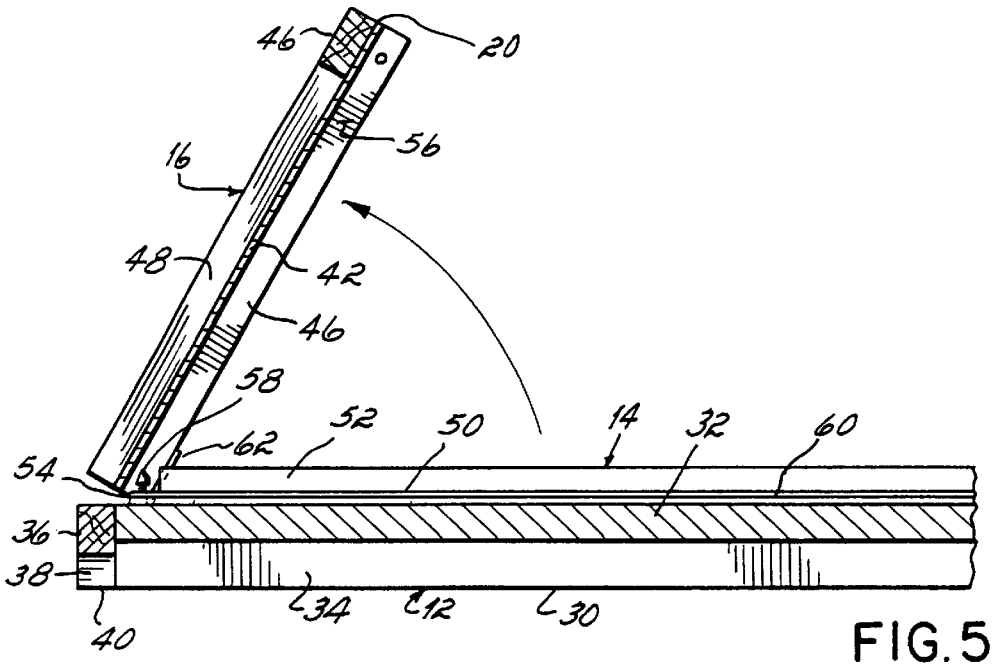
FIG. 5 is a cross-sectional view taken along line 5—5 of FIG. 3.
Figure 6:
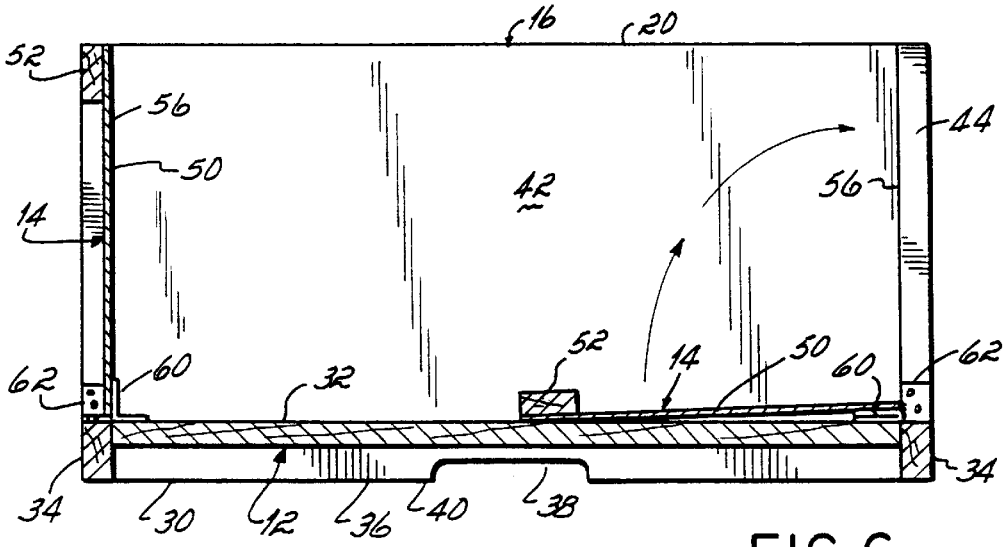
FIG. 6 is a cross-sectional view taken along line 6—6 of FIG. 4.

Referring now to FIG. 2, it will be seen that, in the preferred embodiment of the present invention, the pair of side walls 14, 14 are foldable onto the bottom 12 and the pair of end walls 16, 16 are foldable onto the pair of side walls 14, 14. The pair of lids 18, 18 are of equal length and are positionable on the pair of side walls 14, 14 when the pair of side walls 14, 14 are folded onto the bottom 12, and are positionable between the free edges 20, 20 of the pair of end walls 16, 16 when the pair of end walls 16, 16 are folded onto the pair of side walls 14, 14.

Referring now to FIGS. 1–4, the bottom 12 comprises a rectangular frame 30 and a panel 32 secured to the frame 30. The frame 30 is preferably fabricated of cottonwood, and the panel 32 is preferably fabricated of oriented strand board. The oriented strand board panel 32 is preferably secured to the rectangular cottonwood frame 30 with wood glue. The rectangular frame 30 comprises a pair of side frame members 34, 34, and a pair of end frame members 36, 36. Each of the pair of end frame members 36, 36 includes a cutout 38 therein extending upwardly from a lower edge 40 thereof which serves as a handhold.

Each of the pair of end walls 16, 16 comprises a panel 42, a pair of lateral edge frame members 44, 44 one of which is secured to each lateral edge of the panel 42, and a top edge frame member 46 secured to the top edge of the panel 42. If desired, additional lateral edge frame members 48, 48 may be secured to the panel 42. The frame members 44, 46, 48 are preferably fabricated of cottonwood and the panel 42 is preferably fabricated of luan plywood, i.e. that form of thin plywood normally employed as underlayment for flooring. The luan plywood panel 42 is preferably secured to the cottonwood frame members 44, 46, 48 with wood glue.

Figure 7:
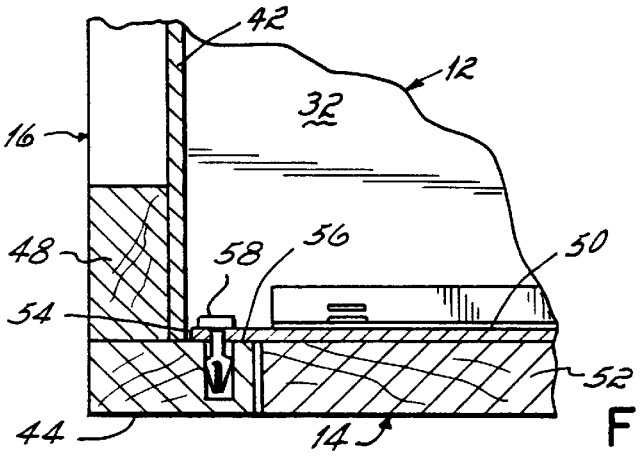
FIG. 7 is a cross-sectional view taken along line 7—7 of FIG. 1.

Each of the pair of side walls 14, 14 comprises a panel 50 and a top edge frame member 52 secured to a top edge of the panel 50. Each frame member 52 is preferably fabricated of cottonwood and each panel 50 is preferably fabricated of luan plywood. The luan plywood panel 50 is preferably secured to the cottonwood frame member 52 with wood glue. Each end edge 54 of each side wall panel 50 abuts an inwardly facing surface 56 of a respective end wall lateral edge frame member 44 when assembled. A fastener 58 fastens each end edge 54 of each side wall panel 50 to the respective end wall lateral edge frame member 44. The fastener 58 is preferably a plastic Christmas tree fastener, wherein the end edge 54 of the side wall panel 50 includes a through hole therethrough and the respective end wall lateral edge frame member 44 includes a blind hole therein, such that the Christmas tree fastener passes through the through hole and resides in the blind hole to thereby retain the end edge 54 of the side wall panel 50 against the inwardly facing surface 56 of the respective end wall lateral edge frame member 44. See FIG. 7.

Referring now to all the Figures, each of the pair of side walls 14, 14 is pivotally connected to the bottom 12 with either a cardboard living hinge 60, or alternatively metal hinges (not shown). Each of the pair of end walls 16, 16 are pivotally connected to the bottom 12 with metal hinges 62.

The pair of lids 18 each comprise a rectangular frame 70 and a panel 72 secured to the frame 70. The frame 70 is preferably fabricated of cottonwood and the panel 72 is preferably fabricated of luan plywood. The luan plywood panel 72 is preferably secured to the rectangular cottonwood frame 70 with wood glue. The pair of lids 18, 18 are fastened to top edges of the pairs of side walls 14, 14 and pairs of end walls 16, 16 with dowel pins 80.

The foldable cremation container 10 of the present invention is so sized and configured that it readily fits into a standard UPS or Federal Express shipping container 90 shown in FIG. 2.

Referring now to FIGS. 8–11, various aspects of the construction of an alternative embodiment cremation container 100 are illustrated. In this embodiment, various steps have been taken to reduce the cost of the container 100, improve the structural integrity of the container 100 in its erected configuration, and provide protection against body fluids.

More particularly, in the embodiment 100 the frames for the side walls, end walls and covers have been eliminated. Medium density fiberboard ("MDF") has been substituted for the luan plywood. The bottom remains constructed of oriented strand board ("OSB"). The hinges hinging the side walls and end walls to the bottom remain unchanged.

Figure 8:
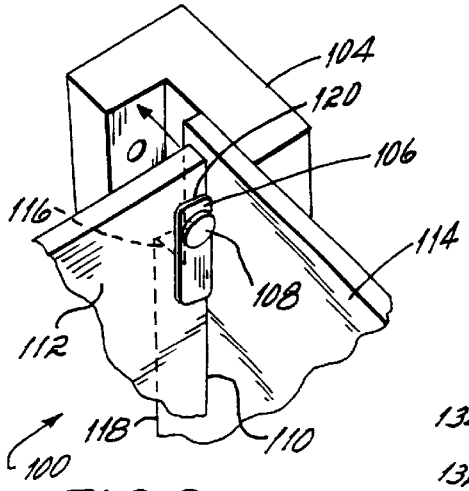
FIG. 8 is a partial perspective view, enlarged, of a corner of an alternative embodiment cremation container illustrating a locking mechanism for locking the side walls in an erected position.
Figure 9:
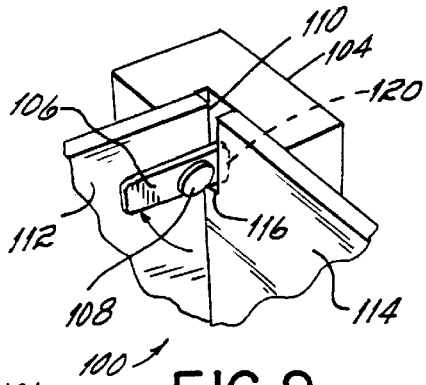
FIG. 9 is a view similar to FIG. 8 with the locking mechanism in the locked position.
Figure 11:
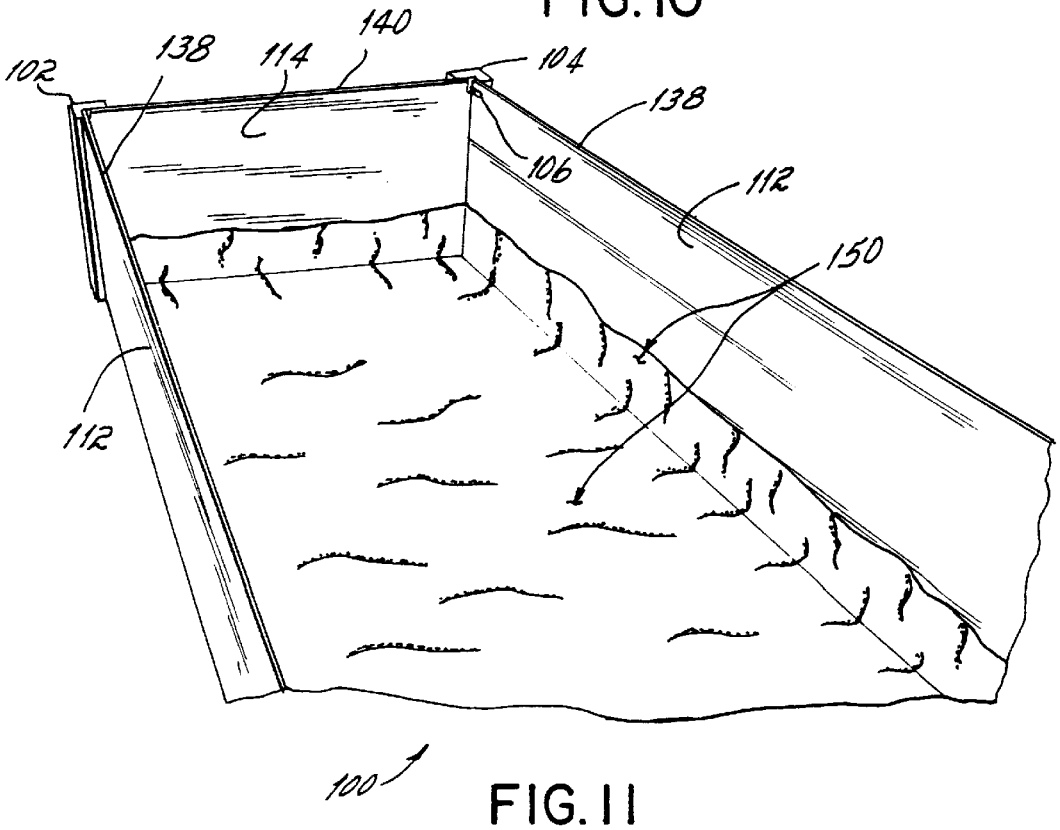
FIG. 11 is a partial perspective view of the container of FIGS. 8–10 illustrating a fluid containment bag placed in the alternative embodiment container.

The alternative embodiment container 100 now includes four L-shaped corner posts, one of which is located at each corner of the container 100, and two of which are illustrated at 102 and 104 (FIG. 11). Referring to FIGS. 8 and 9, a locking lever 106 is pivotally attached with a fastener 108, for instance a friction fit fastener or a barbed plastic fastener known as a plastic Christmas tree fastener, near an end edge 110 of side wall 112. The end wall 114 includes a notch 116 in a lateral edge 118 thereof. As is seen in FIGS. 8 and 9, when side wall 112 is erected, locking lever 106 is rotated clockwise so that its end 120 resides in notch 116 in end wall 114, thus preventing the side wall 112 from collapsing inwardly and downwardly. Locking lever 106 may preferably be fabricated of masonite.

Figure 10:
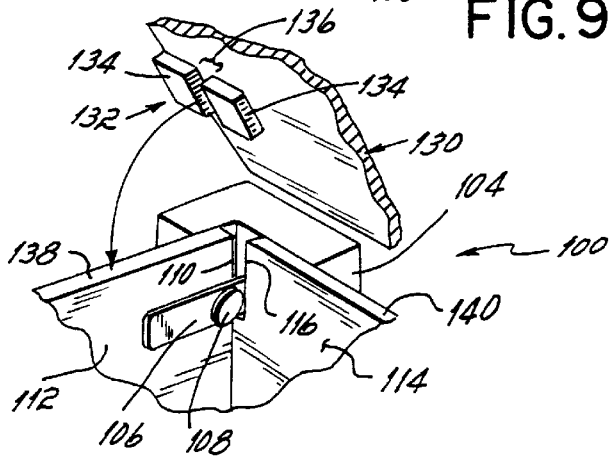
FIG. 10 is a view similar to FIGS. 8 and 9 illustrating another mechanism for securing the covers on the container.

Referring now to FIG. 10, lid 130 now includes a plurality of pairs 132 of cleats 134, 134, for example small wooden blocks screwed to the underneath side of lid 130 with wood screws. Respective cleats 134, 134 of each cleat pair 132 are spaced apart at sufficient distance 136 so as to allow the upper edge 138 of side wall 112 and 140 of end wall 114 to fit therebetween in order to secure the cover 130 onto the side and end walls 112, 114.

Referring now to FIG. 11, a liquid impervious liner 150, such as a polyethylene bag, is provided with the alternative embodiment container 100 for placement in the bottom thereof to protect against leakage of body fluids. The liner 150 may be affixed to the interior of the container 100 with, for example, double-sided tape (not shown). The polyethylene bag 150 may simply be folded up and placed on top of the lids 130 in the knocked down configuration of the container 100 for shipment, as is illustrated for example in FIG. 2.

Those skilled in the art will readily recognize numerous adaptations and modifications which can be made to the present invention which will result in an improved cremation container, yet all of which will fall within the spirit and scope of the present invention as defined in the following claims. For example, the use of alternative materials is within the scope of the invention. For instance, hardboard, particle board, flake board, plywood, solid wood and finger jointed wood may be utilized in the practice of the invention. In addition, while the invention has been referred to herein as a "cremation container," it is to be understood that the term embraces and the invention may be practiced as a burial casket (either above or below ground) or other body containment vessel. Accordingly, the invention is to be limited only by the scope of the following claims and their equivalents.

What is claimed is:

1. A cremation container foldable into a compact configuration for shipping comprising:

a bottom;

a pair of side walls pivotally connected to said bottom;

a pair of end walls pivotally connected to said bottom; and a cover removably positionable atop said pair of side walls and said pair of end walls;

one pair of said pair of side walls and said pair of end walls being foldable onto said bottom, the other pair of said pair of side walls and said pair of end walls being foldable onto said one pair of said pair of side walls and said pair of end walls, to thereby compactly configure said container for shipping;

wherein said cover comprises a pair of equal length covers each of which comprises a rectangular frame and a panel secured to said frame;

wherein said pair of covers are fastened to top edges of said pairs of side walls and end walls with dowel pins.

2. A cremation container foldable into a compact configuration for shipping comprising:

a bottom;

a pair of side walls pivotally connected to said bottom;

a pair of end walls pivotally connected to said bottom; and a cover removably positionable atop said pair of side walls and said pair of end walls;

one pair of said pair of side walls and said pair of end walls being foldable onto said bottom, the other pair of said pair of side walls and said pair of end walls being foldable onto said one pair of said pair of side walls and said pair of end walls, to thereby compactly configure said container for shipping;

further including a locking lever pivotally attached to one of adjacent side and end walls and cooperable with the other of adjacent side and end walls to prevent the one wall from collapsing.

3. A cremation container foldable into a compact configuration for shipping comprising:

a bottom;

a pair of side walls pivotally connected to said bottom;

a pair of end walls pivotally connected to said bottom; and a cover removably positionable atop said pair of side walls and said pair of end walls;

one pair of said pair of side walls and said pair of end walls being foldable onto said bottom, the other pair of said pair of side walls and said pair of end walls being foldable onto said one pair of said pair of side walls and said pair of end walls, to thereby compactly configure said container for shipping;

further including a locking lever pivotally attached near an end edge of each said side wall and a notch in a lateral edge of an adjacent said end wall, said locking lever pivotable into engagement with said notch to prevent said side wall from collapsing.

4. A cremation container foldable into a compact configuration for shipping comprising:

a bottom;

a pair of side walls pivotally connected to said bottom;

a pair of end walls pivotally connected to said bottom; and a cover removably positionable atop said pair of side walls and said pair of end walls;

one pair of said pair of side walls and said pair of end walls being foldable onto said bottom, the other pair of said pair of side walls and said pair of end walls being foldable onto said one pair of said pair of side walls and said pair of end walls, to thereby compactly configure said container for shipping;

wherein said cover includes a plurality of pairs of cleats secured thereto, upper edges of said side and end walls fitting between respective cleats of said pairs of cleats to secure said cover onto said side and end walls.

5. The cremation container of any of claims 1–4 wherein said pair of side walls are foldable onto said bottom and said pair of end walls are foldable onto said pair of side walls.

6. The cremation container of any of claims 1–4 wherein said cover comprises a pair of equal length covers positionable on said pair of side walls when said pair of side walls are folded onto said bottom and positionable between free edges of said pair of end walls when said pair of end walls refolded onto said pair of side walls.

7. The cremation container of any of claims 1–4 wherein said bottom comprises a rectangular frame and a panel secured to said frame.

8. The cremation container of claim 7 wherein said frame is fabricated of cotton wood and said panel is fabricated of oriented strand board.

9. The cremation container of claim 8 wherein said oriented strand board panel is secured to said rectangular cotton wood frame with wood glue.

10. The cremation container of claim 7 wherein said rectangular frame comprises a pair side frame members and a pair of end frame members, and wherein each of said pair of end frame members includes a cut-out therein extending upwardly from a lower edge thereof which serves as a hand hold.

11. The cremation container of any of claims 1–4 wherein each of said pair of end walls comprises a panel, a pair of lateral edge frame members one of whlich is secured to each lateral edge of said panel and a top edge frame member secured to a top edge of said panel.

12. The cremation container of claim 11 wherein said frame members are fabricated of cotton wood and said panel is fabricated of luan plywood.

13. The cremation container of claim 12 wherein said luan plywood panel is secured to said cotton wood frame members with wood glue.

14. The cremation container of claim 11 wherein each of said pair of side walls comprises a panel and a top edge frame member secured to a top edge of said panel, and wherein each end edge of said side wall panel abuts an inwardly facing surface of a respective end wall lateral edge frame member when assembled.

15. The cremation container of claim 14 further comprising a fastener fastening each said end edge of said side wall panel to said respective end wall lateral edge frame member.

16. The cremation container of claim 15 wherein said fastener is a plastic Christmas tree fastener, said end edge of said side wall panel including a through hole therethrough and said respective end wall lateral edge frame member including a blind hole therein, said Christmas tree fastener passing through said through hole and residing in said blind hole to thereby retain said end edge of said side wall panel against said inwardly facing surface of said respective end wall lateral edge frame member.

17. The cremation container of any of claims 1–4 wherein each of said pair of side walls comprises a panel and a top edge frame member secured to a top edge of said panel.

18. The cremation container of claim 17 wherein said frame member is fabricated of cotton wood and said panel is fabricated of luan plywood.

19. The cremation container of claim 18 wherein said luan plywood panel is secured to said cotton wood frame member with wood glue.

20. The cremation container of any of claims 1–4 wherein each of said pair of side walls are pivotally connected to said bottom with a cardboard living hinge.

21. The cremation container of any of claims 1–4 wherein each of said pair of side walls are pivotally connected to said bottom with metal hinges.

22. The cremation container of any of claims 1–4 wherein each of said pair of end walls are pivotally connected to said bottom with metal hinges.

23. The cremation container of any of claims 1–4 wherein siad cover comprises a rectangular frame and a panel secured to said frame.

24. The cremation container of claim 23 wherein said frame is fabricated of cotton wood and said panel is fabricated of luan plywood.

25. The cremation container of claim 24 wherein said luan plywood panel is secured to said rectangular cotton wood frame with wood glue.

26. The cremation container of any of claims 1–4 wherein said cover comprises a pair of equal length covers each of which comprises a rectangular frame and a panel secured to said frame.

27. The cremation container of claim 26 wherein each said frame is fabricated of cotton wood and each said panel is fabricated of luan plywood.

28. The cremation container of claim 27 wherein each said luan plywood panel is secured to a respective said rectangular cotton wood frame with wood glue.

29. The cremation container of any of claims 1–4 further including a polyethylene bag placed in said container to capture fluids.

* * * * *

UNITED STATES PATENT AND TRADEMARK OFFICE

CERTIFICATE OF CORRECTION

PATENT NO. : 6,202,270 B1
DATED : March 20, 2001
INVENTOR(S) : Pat Bowman et al.

It is certified that error appears in the above-identified patent and that said Letters Patent is hereby corrected as shown below:

Column 7,
Line 9, “refolded” should read -- are folded --.
Line 27, “whlich” should read -- which --.

Column 8,
Line 26, “siad” should read -- said --.

Signed and Sealed this

Sixth Day of September, 2005

JON W. DUDAS
*Director of the United States Patent and Trademark Office*